US005547562A

United States Patent [19]

Grewal et al.

[11] Patent Number: 5,547,562

[45] Date of Patent: Aug. 20, 1996

[54] OIL DEWAXING METHOD

[75] Inventors: Rupinder S. Grewal, Sugar Land; Michael E. Joyce, Houston; Randall F. Nord, Sugar Land, all of Tex.

[73] Assignee: Nalco/Exxon Energy Chemicals, L.P., Sugarland, Tex.

[21] Appl. No.: 450,450

[22] Filed: May 25, 1995

[51] Int. Cl.[6] ..... C10G 23/00; C10G 73/06; C10G 73/32

[52] U.S. Cl. ..... 208/24; 208/33; 208/35; 208/37; 208/38

[58] Field of Search ..... 208/24, 33, 35, 208/37, 38

[56] References Cited

U.S. PATENT DOCUMENTS

| | | | |
|---|---|---|---|
| 3,052,623 | 9/1962 | Edwards et al. | 208/38 |
| 4,377,467 | 3/1983 | Achia | 208/35 |
| 4,406,771 | 9/1983 | Briens et al. | 208/33 |
| 4,450,353 | 5/1984 | Briens et al. | 208/33 |
| 4,728,414 | 3/1988 | West et al. | 208/33 |
| 5,098,550 | 3/1992 | Mueller et al. | 208/38 |
| 5,180,483 | 1/1993 | Braams et al. | 208/28 |

*Primary Examiner*—Glenn A. Caldarola
*Assistant Examiner*—Patricia L. Hailey
*Attorney, Agent, or Firm*—James J. Drake; Robert A. Miller; Patricia A. Charlier

[57] ABSTRACT

The invention decloses a method for dewaxing a hydrocarbon oil which comprises adding an oil-soluble poly $C_{18}$–$C_{22}$ alkylmethacrylate having a molecular weight of from about 10,000 to about 2,000,000 daltons to a hydrocarbon oil containing wax; cooling the oil to allow wax crystals to form, separating the wax crystals from the oil and recovering a dewaxed oil.

6 Claims, No Drawings

OIL DEWAXING METHOD

BACKGROUND OF THE INVENTION

1. Field of the Invention

The invention relates to a method for removing wax and waxy contaminants from hydrocarbon liquids.

2. Description of the Prior Art

Lube oil basestocks are obtained from crude oil vacuum distillation units and are separated according to viscosity and boiling point specifications. One undesirable characteristic of these basestocks is the presence of paraffin wax (high molecular weight hydrocarbons) which is responsible for poor flow properties at ambient temperatures. The paraffin wax is removed in a process called "dewaxing" in order to obtain a finished oil with good pour point properties.

There are two types of dewaxing processes in use today, solvent dewaxing and catalytic dewaxing. Solvent dewaxing utilizes a solvent to dilute the waxy raffinate in conjunction with refrigeration to crystallize out the wax which is then filtered. Catalytic dewaxing is a selective hydrocacking process to crack waxy molecules to lighter hydrocarbons.

Basestocks which are difficult to filter sometimes require a processing aid commonly referred to as a "Dewaxing Aid". These dewaxing additives modify wax crystal formation to improve filterability, oil yield, oil in wax content, and/or reduce the amount of solvent dilution. The pour point of the dewaxed oil is usually not affected by dewaxing aids. Unfortunately, due to the compositional variation between basestocks, a dewaxing additive which enhances the performance in one basestock may not work at all in another. Desirably, an additive that works well across all basestocks would be available.

SUMMARY OF THE INVENTION

The invention discloses a method for dewaxing a hydrocarbon oil which comprises adding an oil-soluble poly $C_{18}$–$C_{22}$ alkylmethacrylate having a molecular weight of from about 10,000 to about 2,000,000 daltons to a hydrocarbon oil containing wax; cooling the oil to allow wax crystals to form, separating the wax crystals from the oil and recovering a dewaxed oil.

DESCRIPTION OF THE PREFERRED EMBODIMENTS

The invention discloses a method for dewaxing a hydrocarbon oil which comprises adding an oil-soluble poly $C_{18}$–$C_{22}$ alkylmethacrylate having a molecular weight of from about 10,000 to about 2,000,000 daltons to a hydrocarbon oil containing wax; cooling the oil to allow wax crystals to form, separating the wax crystals from the oil and recovering a dewaxed oil. More preferably, the molecular weight is from about 200,000 to about 1 million daltons. Most preferably, the molecular weight is from about 300,000 to about 600,000 daltons.

Preferably, oil-soluble poly $C_{18-22}$ alkylmethacrylate is a polybehenylmethacrylate having a distribution of the alkyl groups in the poly $C_{18}$–$C_{22}$ alkylmethacrylate. More preferably, the alkylmethacrylate has about 30–35% by weight $C_{18}$, about 5–15% by weight $C_{20}$ and about 30–45% by weight $C_{22}$. In a preferred embodiment of the invention, the wax crystals are separated from the oil by filtration. Preferably, the wax containing oil is a lubricating oil basestock.

The following examples are presented to describe preferred embodiments and utilities of the invention and are not meant to limit the invention unless otherwise stated in the claims appended hereto.

EXAMPLES

Procedure for the Synthesis of Polymer:

A mixture of behenyl methacrylate (75%), aromatic solvent (25%) and a small amount of 1-dodecanethiol was heated to 83°C. Then a small amount of initiator azoisobutyronitfile (AIBN) was added. The reaction was kept at this temperature for 6–8 hours and more initiator was added as needed. The reaction was monitored by an IR spectrum. When the residual monomer was less than 5% as determined by the intensity of the signal at approximately 1640 $cm^{-1}$, the reaction mixture was diluted with solvent to the desired concentration.

For a typical test procedure, 75.0 grams of raffinate with dewaxing aid was dissolved in 187.5 grams of hot heptane (1:2.5 raffinate to solvent ratio). Next, the solution was stirred and cooled to −30° C. in a jacketed beaker (−35° C. methanol was circulated through the beaker jacket). Ater the solution attained the required temperature (30 minutes), the solution was vacuum filtered (350 mm Hg) and the filtration time noted. All solutions were filtered for a minimum of 240 seconds before observing the wax cake. Finally, the solvent was removed and oil yield determined.

EXAMPLE 1

Research efforts were directed toward polymers based on behenyl meethacrylate, stearly methacrylate and lauryl methacrylate. These samples were tested in both the HPCL 500 Neutral and HPCL TOBS raffinates. Test results (TABLE II) indicated that poly(behenyl methacrylate) outperformed mixed methacrylate compounds in TABLE I.

EXAMPLE 2

The performance dependance on polymer molecular weight was investigated next. A number of samples of poly(behenyl methacrylate) were synthesized having GPC molecular weight range from 100,000 to 2,000,000 (TABLE I). The polymer molecular weight was controlled by addition of various amounts of the chain transfer agent 1-dodecanethiol. All the samples performed equally well as a dewaxing aid. Lower molecular weight is preferred to give the product good flow properties (low viscosity). As can be seen from the results in TABLE II, the relative ratio of C18–C22 alkylmethacrylate monomers is important for performance as indicated by the test results.

TABLE II

| Additive Description | Dosage (ppm) | Wax Cake Appearance | Filtration Time (sec) | % Oil Yield |
|---|---|---|---|---|
| HPCL 500 NEUTRAL BASESTOCK | | | | |
| Blank | — | moist, no cracks | >240 | 54 |
| esterified alpha-olefin/maleic anhydride copolymer | 200 | moist, no cracks | 240 | 51 |

TABLE II-continued

| Additive Description | Dosage (ppm) | Wax Cake Appearance | Filtration Time (sec) | % Oil Yield |
|---|---|---|---|---|
| (C10–18 olefin, C4–C18 alcohol) | | | | |
| esterified alpha-olefin/maleic anhydride copolymer (C10–18 olefin, C4–C18 alcohol) | 500 | moist, no cracks | 240 | 51 |
| esterified alpha-olefin/maleic anhydride copolymer (C10–18 olefin, C4–C18 alcohol) | 500 | moist, no cracks | 180 | 68 |
| esterifield styrene-maleic anhydride copolymer (C20 + alcohol) | 250 | moist, no cracks | 180 | 54 |
| esterifield styrene-maleic anhydride copolymer (C20 + alcohol) | 500 | moist, no cracks | 120 | 65 |
| esterifield styrene-maleic anhydride copolymer (C20 + alcohol) | 1000 | moist, no cracks | 180 | 72 |
| esterifield styrene-maleic anhydride copolymer (C20 + alcohol) | 1500 | moist, no cracks | 240 | 72 |
| CPS behenyl methacrylate monomer | 500 | moist, no cracks | 240 | |
| CPS behenyl methacrylate monomer | 500 | dry, many cracks | 30 | |
| CPS behenyl methacrylate monomer | 375 | dry, many cracks | 60 | 80 |
| CPS behenyl methacrylate monomer | 500 | dry, many cracks | 60 | 80 |
| CPS behenyl methacrylate monomer | 1250 | dry, many cracks | 30 | 78 |
| CPS behenyl methacrylate monomer | 2500 | dry, many cracks | 30 | 81 |
| CPS behenyl methacrylate monomer | 500 | dry, many cracks | 60 | |
| CPS behenyl methacrylate monomer | 500 | moist, no cracks | 150 | |
| Henkyl behenyl methacrylate monomer | 375 | moist, no cracks | 120 | 68 |
| Henkyl behenyl methacrylate monomer | 750 | moist, no cracks | 120 | 64 |
| Henkyl behenyl methacrylate monomer | 375 | dry, many cracks | 30 | 80 |
| Henkyl behenyl methacrylate monomer | 750 | dry, many cracks | 60 | 77 |
| HPCL TOBS BASESTOCK | | | | |
| Blank | — | moist, few cracks | 180 | 58 |
| CPS behenyl methacrylate monomer | 375 | dry, many cracks | 90 | 75 |
| CPS behenyl methacrylate monomer | 750 | dry, many cracks | 30 | 76 |

TABLE III

| Additive Description | Dosage (ppm) | Wax Cake Appearance | Filtration Time (sec) | % Oil Yield |
|---|---|---|---|---|
| EXXON BRIGHT STOCK | | | | |
| Blank | — | very moist | >240 | 40 |
| Esterified styrene maleic anhydride polymer | 500 | very moist | >240 | 47 |
| esterified alpha-olefin/maleic anhydride copolymer (C24–28 olefin, C20 + alcohol) | 500 | very moist | >240 | 25 |
| esterified alpha-olefin/maleic anhydride copolymer (C10–18 olefin, C4–C18 alcohol) | 500 | very moist | >240 | 22 |
| Polybehenyl methacrylate polymer | 250 | moist, no cracks | 240 | 65 |
| Polybehenyl methacrylate polymer | 500 | moist, no cracks | 210 | 67 |
| Polybehenyl methacrylate polymer | 750 | moist, no cracks | 180 | 70 |
| Polybehenyl methacrylate polymer | 1000 | moist, no cracks | 180 | 68 |
| Polybehenyl methacrylate polymer | 1500 | moist, no cracks | 180 | 68 |
| EXXON's 600 NEUTRAL | | | | |
| Blank | — | moist, no cracks | >240 | |
| esterified alpha-olefin/maleic anhydride copolymer (C24–28 olefin, C20 + alcohol) | 500 | very moist | 150 | 40 |
| esterified alpha-olefin/maleic anhydride copolymer (C10–18 olefin, C4–C18 alcohol) | 500 | very moist | 150 | 34 |
| Esterified styrene maleic anhydride polymer | 250 | dry, few cracks | 90 | 51 |
| Esterified styrene maleic anhydride polymer | 500 | dry, few cracks | 120 | 50 |
| Esterified styrene maleic anhydride polymer | 750 | dry, few cracks | 90 | 62 |
| Esterified styrene maleic anhydride polymer | 1000 | moist, no cracks | 240 | 44 |
| Polybehenyl methacrylate polymer | 250 | dry, few cracks | 150 | 47 |
| Polybehenyl methacrylate polymer | 500 | dry, many cracks | 60 | 62 |
| Polybehenyl methacrylate polymer | 750 | dry, many cracks | 60 | 67 |
| Polybehenyl methacrylate polymer | 1000 | dry, many cracks | 60 | 64 |

Changes can be made in the composition, operation and arrangement of the method of the present invention described herein without departing from the concept and scope of the invention as defined in the following claims:

We claim:

1. A method for dewaxing a hydrocarbon oil which comprises:

a. adding polybehenyl methacrylate having a molecular weight of from about 10,000 to about 2,000,000 daltons to a hydrocarbon oil containing wax;

b. cooling the oil to allow wax crystals to form;

c. separating the wax crystals from the oil; and d. recovering a dewaxed oil.

2. The method of claim 1 wherein the wax crystals are separated from the oil by filtration.

3. The method of claim 1 wherein the distribution of the alkyl groups in the polybehenyl methacrylate is about 30–35% by weight $C_{18}$, about 5–15% by weight $C_{20}$ and about 30–45% by weight $C_{22}$.

4. The method of claim 1 wherein the wax containing oil is a lubricating oil basestock.

5. The method of claim 1, wherein the molecular weight is from about 200,000 to about 1 million daltons.

6. The method of claim 5, wherein the molecular weight is from about 300,000 to about 600,000 daltons.

* * * * *